US007523777B2

(12) United States Patent
Kim

(10) Patent No.: US 7,523,777 B2
(45) Date of Patent: Apr. 28, 2009

(54) ROMAN SHADE

(76) Inventor: Chang Ryeol Kim, 503-Ho 111-Dong Dusan-Apt. 3-GA Kumho-Dong, Seongdong-Gu, Seoul (KR) 133-751

( * ) Notice: Subject to any disclaimer, the term of this patent is extended or adjusted under 35 U.S.C. 154(b) by 494 days.

(21) Appl. No.: 10/556,661

(22) PCT Filed: Dec. 24, 2003

(86) PCT No.: PCT/KR03/02832

§ 371 (c)(1),
(2), (4) Date: Nov. 11, 2005

(87) PCT Pub. No.: WO2004/101942

PCT Pub. Date: Nov. 25, 2004

(65) Prior Publication Data

US 2007/0039695 A1 Feb. 22, 2007

(30) Foreign Application Priority Data

May 14, 2003 (KR) ..... 20-2003-0014868 U
Dec. 4, 2003 (KR) ..... 10-2003-0087683

(51) Int. Cl.
*A47H 5/00* (2006.01)

(52) U.S. Cl. ..... 160/84.01; 160/321; 160/193; 160/170

(58) Field of Classification Search ..... 160/84.01, 160/84.04, 84.05, 84.06, 84.07, 170, 193, 160/319, 321; 49/325; 74/89.2; 474/203; 192/223.4

See application file for complete search history.

(56) References Cited

U.S. PATENT DOCUMENTS 4,151,754 A * 5/1979 Reist ..... 74/89.2
5,996,667 A * 12/1999 Fun ..... 160/84.01
6,843,302 B2 * 1/2005 Nijs ..... 160/321

FOREIGN PATENT DOCUMENTS

| | | |
|---|---|---|
| EP | 0 717 166 A1 | 6/1996 |
| JP | 10-159467 | 6/1998 |
| KR | 20-0179141-0000 | 2/2000 |
| KR | 20-0267467-0000 | 2/2002 |

OTHER PUBLICATIONS

International Search Report for PCT/KR2003/002832, dated Mar. 3, 2004; ISA/AT.

* cited by examiner

*Primary Examiner*—Blair M. Johnson
(74) *Attorney, Agent, or Firm*—Harness, Dickey & Pierce, P.L.C.

(57) ABSTRACT

A roman shade comprises an operation box section for rotating a rotation gear as a driving ball chain (25) is pulled down; a rotation shaft (40) fitted into the rotation gear; a frame surrounding the operation box and the rotation shaft (40) and secured to a wall or ceiling; and a ball chain box section including an inside gear which is fitted around the rotation shaft (40), a driven ball chain (22) which has balls to be engaged into grooves defined on the inside gear so that the driven ball chain (22) is moved vertically as the inside gear is rotated, and a ball chain box in which the driven ball chain (22) is compiled without being entangled.

13 Claims, 8 Drawing Sheets

ROMAN SHADE

TECHNICAL FIELD

The present invention relates, in general, to a roman shade, and, more particularly, to a roman shade in which a ball chain is employed to rotate a shaft so that a reliable operation of the roman shade is ensured and a balanced state of a cloth is maintained while the cloth is raised and lowered, and which is constructed to prevent the cloth from sagging from its own weight so that the cloth can be reliably held at a desired height.

BACKGROUND ART

Generally, window shades are divided, depending upon their designs, into a curtain which is folded and unfolded leftward and rightward, a blind which has a plurality of slats capable of being adjusted in their inclination angle, a roll screen which has a sheet capable of being wound on and unwound from a rotation roll, and a roman shade which has a cloth capable of forming folds thereon when it is raised by manipulation of a cord.

Referring to FIG. 1 illustrating a conventional roman shade, an operation box 30 is provided at an end of a frame 10. In the operation box 30, a driving cord 25 is wound on a reel. While not shown in FIG. 1, the driving cord 25 is operatively connected with driven cords 22 each of which is fastened to a cloth 20 by the medium of rings at predetermined positions. If the driving cord 25 is manipulated to be moved upward and downward, the driven cords 22 are also moved upward and downward. In this way, in the conventional roman shade, the cloth 20 is raised and lowered using the driving cord 25.

However, in the conventional roman shade, a problem is caused in that, when the driving cord 25 is wound on and unwound from the reel to raise and lower the cloth 20, since portions of the driving cord 25 are overlapped one on another on the reel, the cloth 20 is likely to be maintained in an unbalanced state.

The conventional roman shade uses the driving cord 25 which is formed of yarn or fabric tape. In the case that the driving cord 25 is formed of yarn, while the cloth is raised and lowered, the driving cord 25 is apt to get entangled. This being the case, if the driving cord 25 is not appropriately disentangled, the driving cord 25 should be replaced with a new one. In the case that the driving cord 25 is formed of fabric tape, the fabric tape is wounded in a groove which is defined on a rotation gear, but the fabric tape is apt to be jammed in the groove.

Another roman shade is disclosed in the art. In this roman shade, an operation box is provided at an upper end of the roman shade. In the operation box, a chain is wound on a shaft, so that a cloth can be raised and lowered as a user pulls down one or the other portion of the chain. In the prior roman shade employing this type of chain, when a cloth is stopped in its movement after being raised or lowered through manipulation of the chain, the cloth is likely to sag from its own weight. In consideration of this fact, in the another roman shade, the chain is hooked on a ring secured to the operation box so as to prevent the cloth from sagging. Nevertheless, in this roman shade, defects are caused in that the procedure for hooking the chain on the ring every time the cloth is moved to a desired height is bothersome.

To cope with these defects, the present applicant disclosed in Korean Utility Model Registration No. 179141 a head rail for a roman shade, in which the driving cord and the driven cords are replaced with ball chains. The power transmission between the driving cord and the driven cords is converted into that between a rotation gear and a rotation shaft, so that the cloth can be maintained in a balanced state and entanglement between the driving cord and the driven cords can be avoided. Also, the present applicant disclosed in Korean Utility Model Registration No. 267467 an operation box for a roman shade, which is constructed to prevent the cloth from sagging from its own weight when the chain is pulled down to raise the cloth and then released.

While the head rail and the operation box effectively solve the defects caused in the conventional roman shade, it is still necessary to change a shape of the rotation gear, improve operational reliability of the ball chain, prevent noise generation while keeping the cloth from sagging, and allow the cloth to be easily cleaned.

DISCLOSURE OF THE INVENTION

Accordingly, the present invention has been made keeping in mind the above problems occurring in the prior art, and an object of the present invention is to provide a roman shade which can maintain a cloth in a balanced state and prevent a cord from being entangled.

Another object of the present invention is to provide a roman shade in which gears and ball chains are reliably operated.

Another object of the present invention is to provide a roman shade which operates with minimal noise.

Still another object of the present invention is to provide a roman shade which can prevent a cloth from sagging to allow the cloth to be reliably maintained at a desired height.

Yet still another object of the present invention is to provide a roman shade which allows a cloth to be easily replaced or cleaned.

In order to achieve the above objects, according to one aspect of the present invention, there is provided a roman shade comprising: an operation box section for rotating a rotation gear as a driving ball chain is pulled down; a rotation shaft fitted into the rotation gear; a frame surrounding the operation box and the rotation gear and secured to a wall or ceiling; and a ball chain box section including an inside gear which is fitted around the rotation shaft and driven ball chains which are connected to a cloth, so that the driven ball chains can raise and lower the cloth in conformity with a rotating direction of the inside gear.

According to another aspect of the present invention, the operation box section comprises a bracket having a body part and a tubular boss part which projects from a surface of the body part and through which the rotation shaft passes; a clutch spring placed around the boss part and having large and small circumference regions which are bordered from each other by a pair of projecting ends constituting both ends of the clutch spring, so that the clutch spring is twisted to be prevented from being rotated when either one of the projecting ends is biased from the small circumference region toward the large circumference region and the clutch spring is untwisted to be freely rotated when either one of the projecting ends is biased from the large circumference region toward the small circumference region; a rotation gear having a gear body which is fitted around the boss part of the bracket by way of the clutch spring and possesses an annular configuration, a ball chain-winding part which is coupled to a surface of the gear body to project in an axial direction and on which the ball chain is wound, and a pair of spring operating parts which are formed on an inner surface of the gear body and positioned in the large circumference region of the clutch spring; a gear member for the rotation shaft, having a support part, a coupling part which projects from a surface of the support part and is coupled with the rotation shaft, and a pair of rotation preventing parts which project from the surface of the support part around and in parallel with the coupling part and are positioned in the large and small circumference regions of the clutch spring; and a cover detachably fastened to the bracket in a state where the clutch spring, the rotation gear, and the gear member for the rotation shaft are accommodated in the bracket.

According to another aspect of the present invention, the ball chain box section may comprise an inside gear which is fitted around the rotation shaft, a driven ball chain which has balls to be engaged into grooves defined on the inside gear so that the driven ball chain is moved in upward and downward directions as the inside gear is rotated, and a ball chain box in which the driven ball chain is compiled without being entangled.

Here, it is advantageous that a separation rib is formed on the body part around the boss part of the bracket to separate the clutch spring from the surface of the body part by a predetermined distance.

Also, it is preferred that a first circular rib is formed on the surface of the support part of the gear member to be positioned around the boss part of the bracket and thereby prevent the clutch spring from being moved in an axial direction of the rotation shaft.

A groove is formed on an exposed surface of each spring operating part of the rotation gear, which faces the cover, and a second circular rib is formed on the surface of the support part of the gear member to be rotatably engaged into the groove.

At this time, the second circular rib is placed radially outward of the first circular rib.

A guide groove for guiding movement of the ball chain may be defined on a front surface of the ball chain box in a lengthwise direction of the ball chain box.

According to another aspect of the present invention, the ball chain box is composed of front and rear cases, and a fastening piece which is defined with a ball chain insertion hole is secured to one or both of the front and rear cases.

According to still another aspect of the present invention, one or more ball chain release-preventing protrusions are formed at predetermined locations inside the ball chain box.

According to yet still another aspect of the present invention, Velcro brand hook and loop fastener strips are attached to a front surface of the frame and an upper portion of the cloth, which is to be brought into contact with the front surface of the frame.

BRIEF DESCRIPTION OF THE DRAWINGS

The above and other objects, features and other advantages of the present invention will be more clearly understood from the following detailed description when taken in conjunction with the accompanying drawings, in which.

BEST MODE FOR CARRYING OUT THE INVENTION

Figure 1:
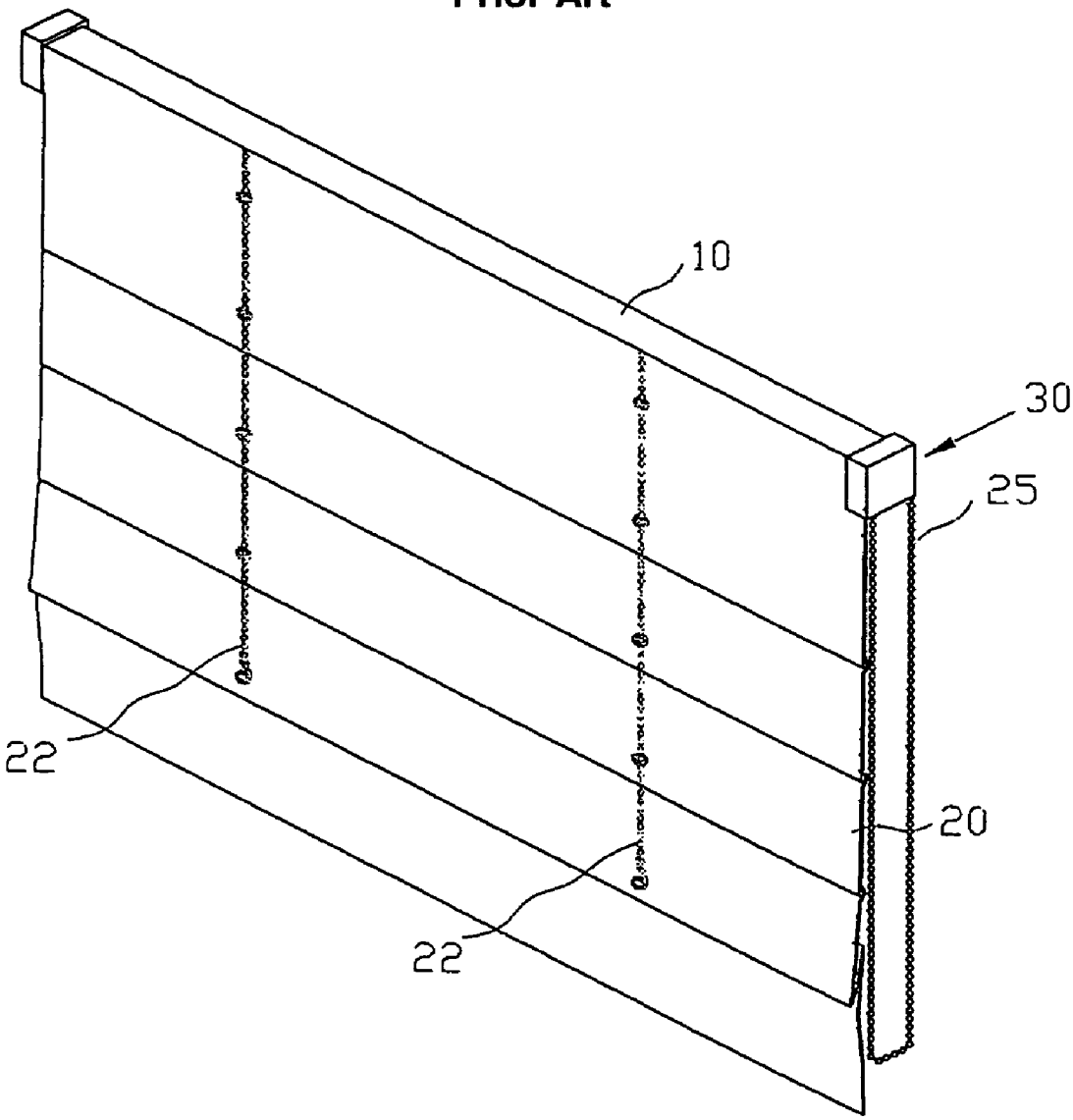
FIG 1 Prior Art
FIG. 1 is a perspective view illustrating a conventional roman shade.

Reference will now be made in greater detail to a preferred embodiment of the invention, an example of which is illustrated in the accompanying drawings. Wherever possible, the same reference numerals will be used throughout the drawings and the description to refer to the same or like parts.

While the conventional roman shade shown in FIG. 1 and the present roman shade shown in FIG. 2 have a difference in their outer appearances, since this difference does not influence the object, construction and working effect of the present invention, the difference between the outer appearances of the conventional roman shade shown in FIG. 1 and the present roman shade shown in FIG. 2 will be neglected in the following description.

Figure 3:
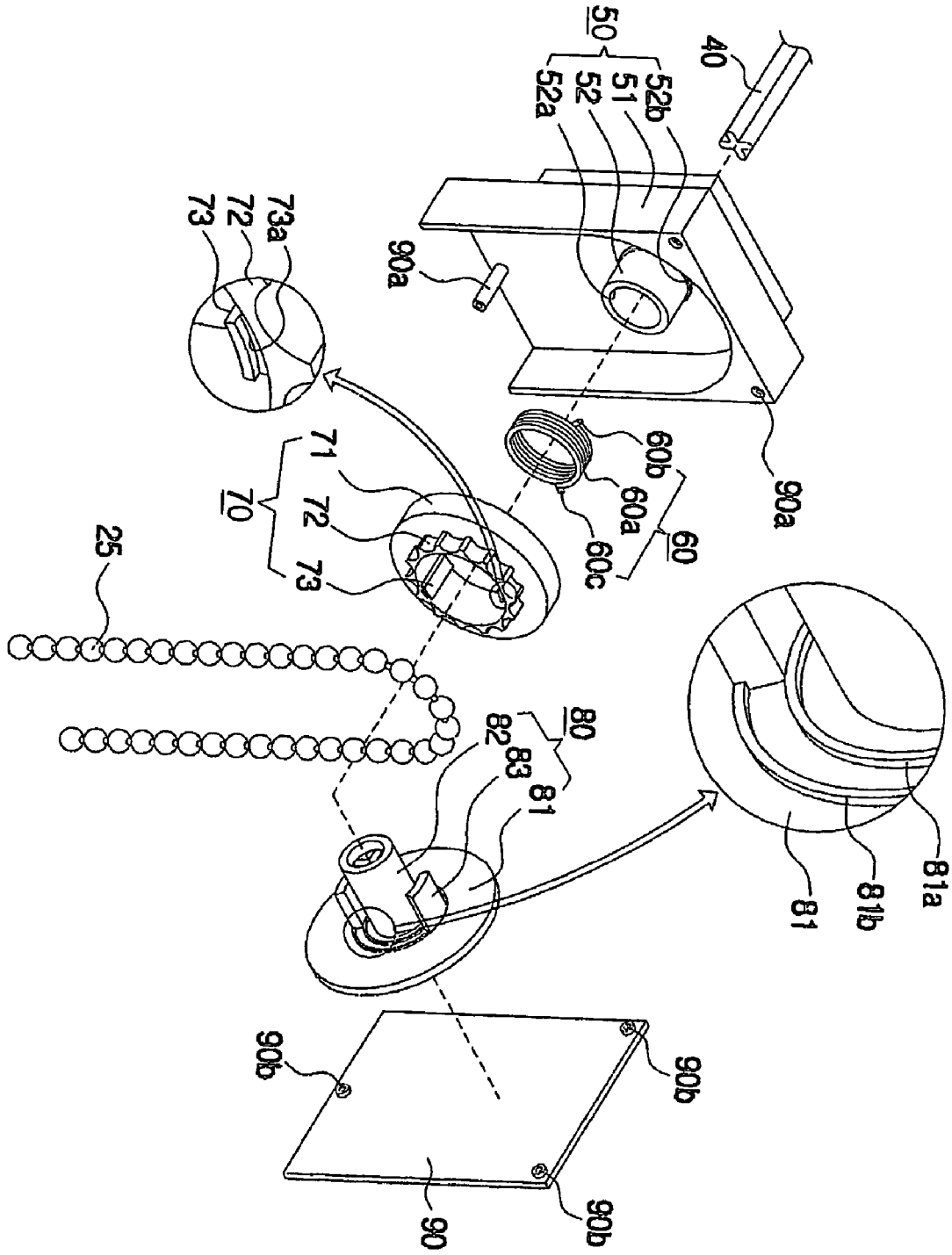
FIG. 3 is a partially enlarged exploded perspective view illustrating an operation box shown in FIG. 2.
Figure 4A:
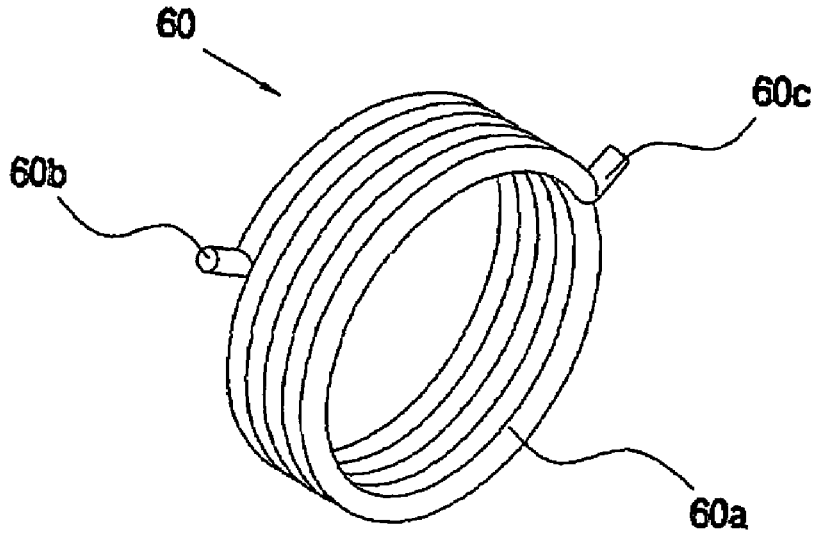
FIGS. 4*a* and 4*b* are respectively a perspective view and a plan view of a clutch spring.
Figure 4B:
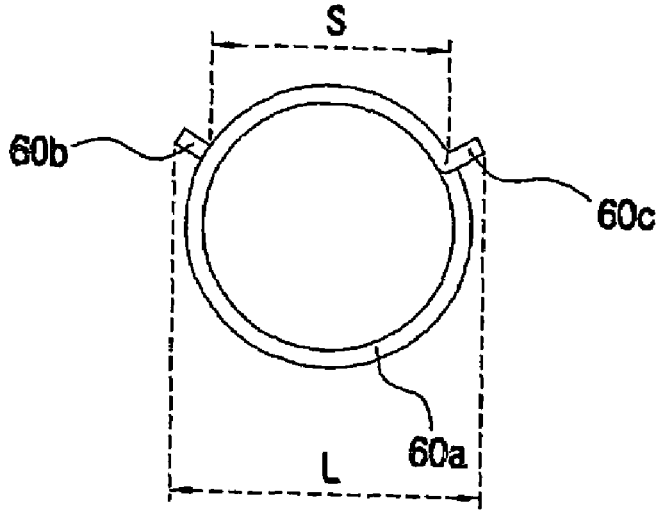
Figure 5:
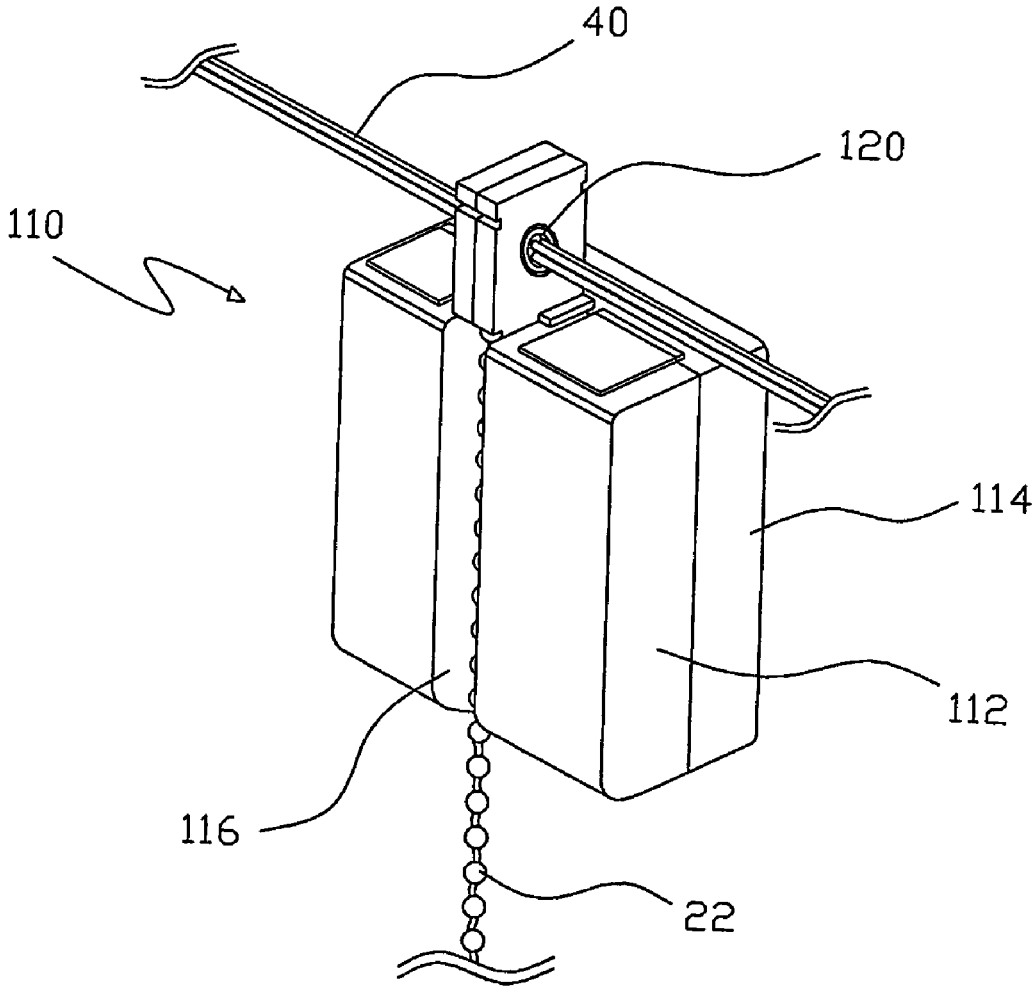
FIG. 5 is a partial enlarged perspective view illustrating a rotation shaft and a ball chain box shown in FIG. 2.
Figure 6:
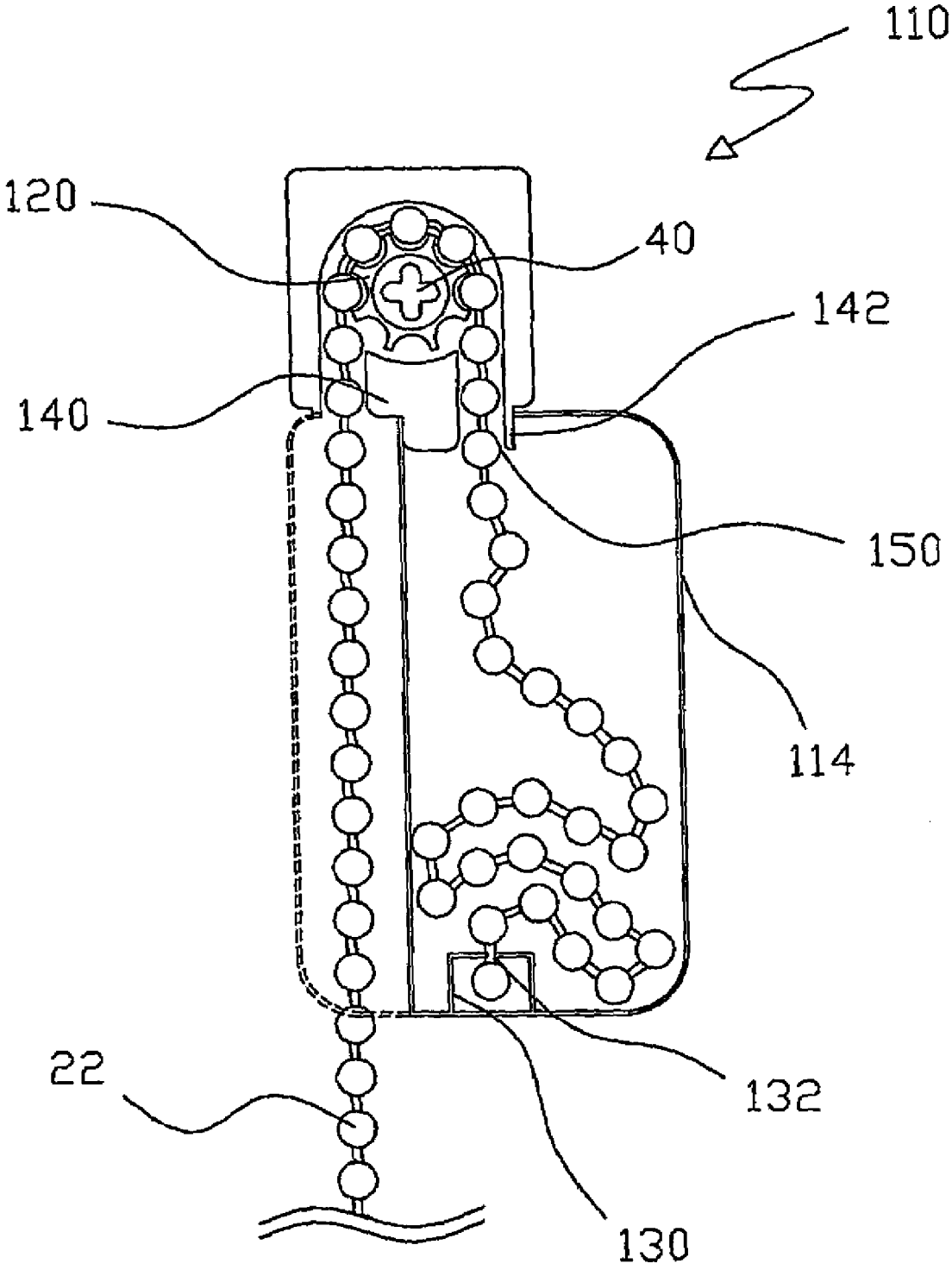
FIG. 6 is a cross-sectional view of the ball chain box shown in FIG. 5.
Figure 7A:
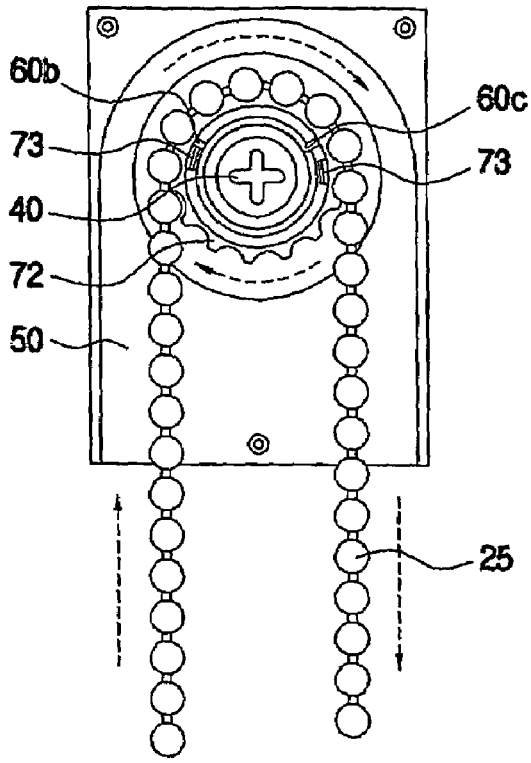
FIGS. 7*a* and 7*b* are views respectively illustrating states wherein a ball chain is manipulated to raise and lower a cloth.
Figure 7B:
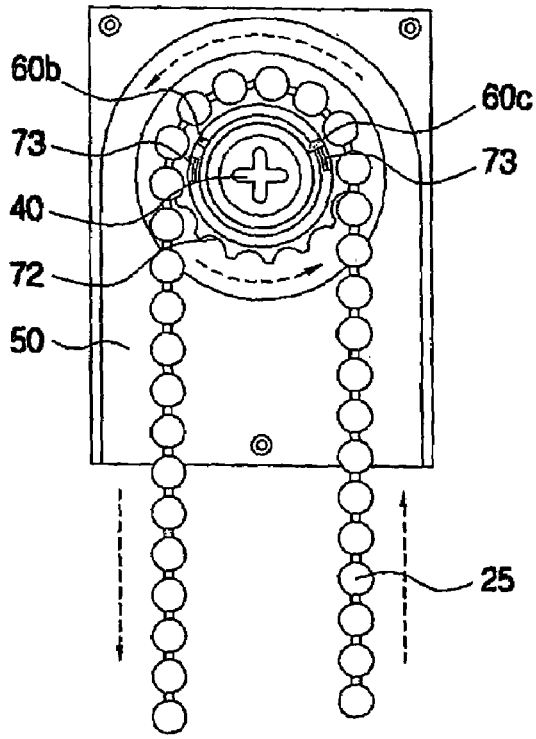
Figure 8A:
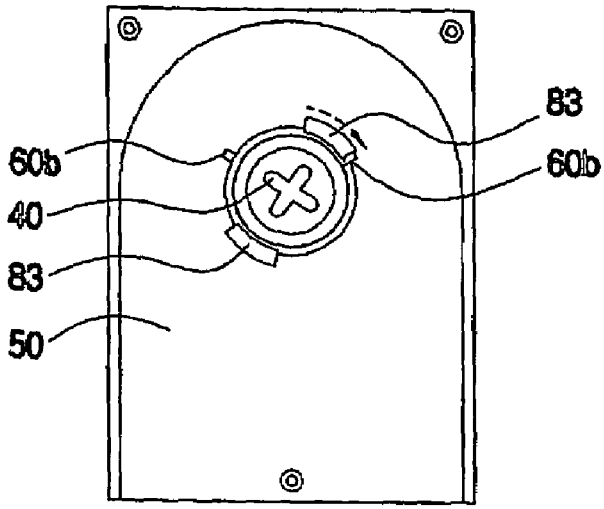
FIGS. 8*a* and 8*b* are views respectively illustrating states wherein a gear member for the rotation shaft acts on the clutch spring to prevent the cloth from sagging from its own weight.
Figure 8B:
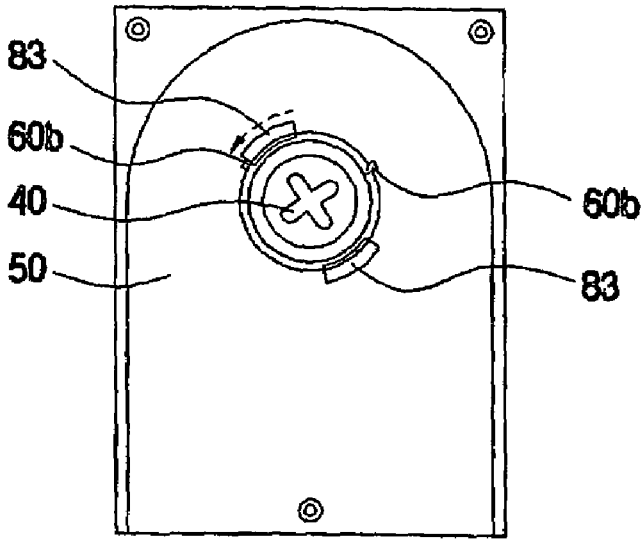

FIG. 1 is a perspective view illustrating a conventional roman shade; FIG. 2 is a partially broken-away perspective view illustrating a roman shade in accordance with an embodiment of the present invention; FIG. 3 is a partially enlarged exploded perspective view illustrating an operation box shown in FIG. 2; FIGS. 4*a* and 4*b* are respectively a perspective view and a plan view of a clutch spring; FIG. 5 is a partial enlarged perspective view illustrating a rotation shaft and a ball chain box shown in FIG. 2; FIG. 6 is a cross-sectional view of the ball chain box shown in FIG. 5; FIGS. 7*a* and 7*b* are views respectively illustrating states wherein a ball chain is manipulated to raise and lower a cloth; and FIGS. 8*a* and 8*b* are views respectively illustrating states wherein a gear member for the rotation shaft acts on the clutch spring to prevent the cloth from sagging from its own weight.

Figure 2:
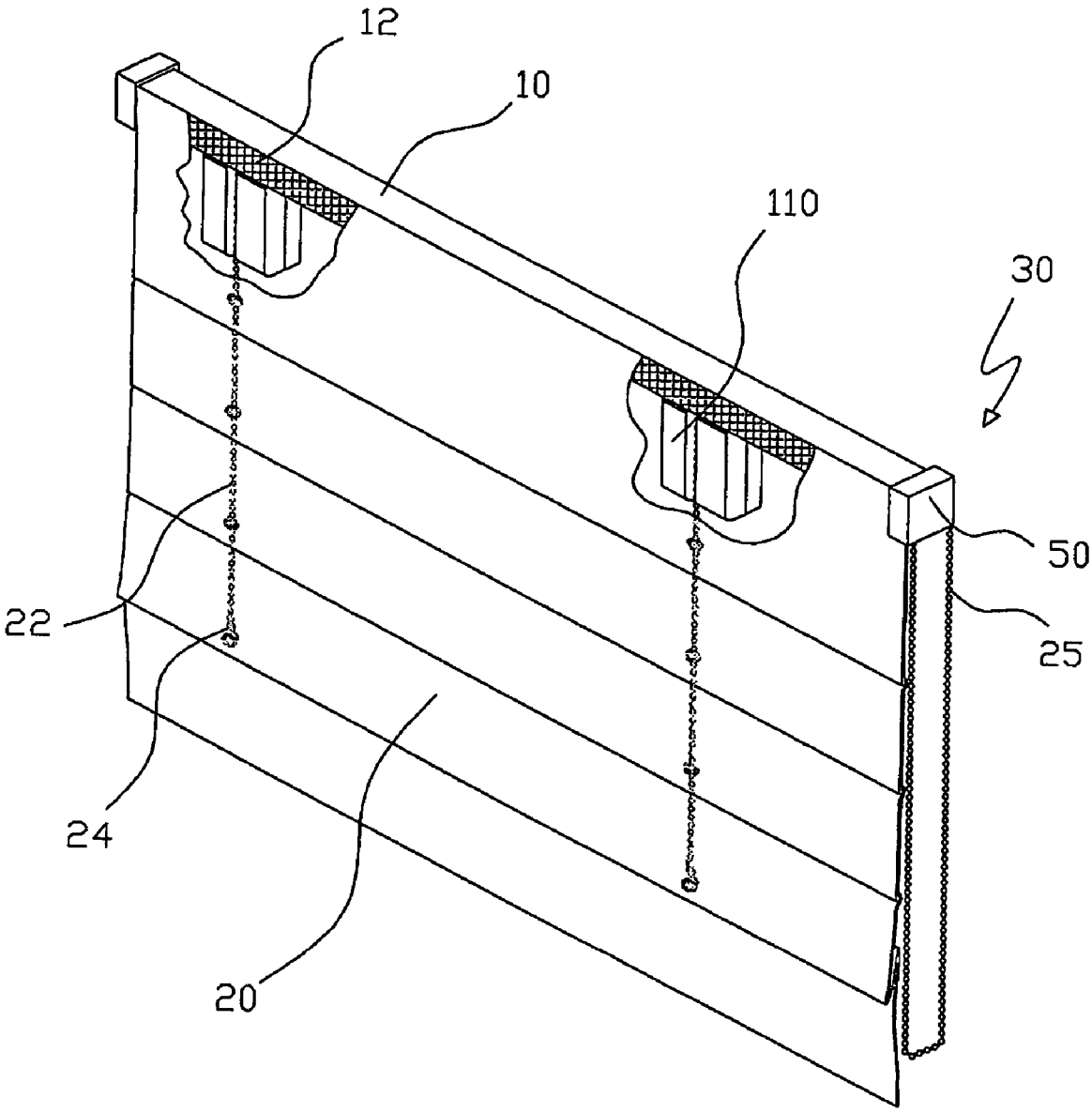
FIG. 2 is a partially broken-away perspective view illustrating a roman shade in accordance with an embodiment of the present invention.

Referring to FIG. 2, in a roman shade in accordance with an embodiment of the present invention, an operation box 50 is provided at a right end of a frame 10. A Velcro brand hook and loop fastener strip 12 is secured to a front surface of the fratne 10, so that the Velcro brand hook and loop fastener strip 12 can be coupled with a complementary Velcro brand hook and loop fastener strip secured to an upper end portion of a cloth 20. Therefore, it is possible to detach only the cloth 20 from the frame 10 so that the cloth 20 can be attached again to the frame 10 after being cleaned.

Referring to FIGS. 3 and 5, a rotation gear 70 is fitted around a rotation shaft 40, and ball chain boxes 110 are provided on the rotation shaft 40 at a regular interval. A guide groove 116 is vertically defined on a front surface of each ball chain box 110, and a driven ball chain 22 is inserted in the guide groove 116 to downwardly extend from the inside of the ball chain box 110.

Each driven ball chain 22 is knotted to the cloth 20 at positions which are vertically separated one from another by a predetermined interval. A lower end of each driven ball chain 22 is provided with a ring 24 (FIG. 2) by which the lower end of the driven ball chain 22 is connected to the cloth 20. Accordingly, by pulling down one portion or the opposing other portion of the driving ball chain 25, the driven ball chains 22 are integrally moved upward or downward to raise or lower the cloth 20. Each driven ball chain 22 has the same configuration as the driving ball chain 25.

Referring again to FIG. 3, the rotation shaft 40, a bracket, a clutch spring 60, a rotation gear 70, a gear member 80 for the rotation shaft 40, and a cover 90 are detachably assembled one with another from a left end toward a right end. The driving ball chain 25 is wound on the rotation gear 70 so that some balls of the driving ball chain 25 are meshed with some teeth of the rotation gear 70. The driving ball chain 25 is formed in a manner such that a plurality of plastic balls are threaded on a cord at a regular interval.

The bracket has a rectangular plate-shaped body part 51 and a boss part 52 which projects from a center portion of a surface of the body part 51 toward the cover 90. The boss part 52 has a tubular configuration and defines an opening 52*a* through which the rotation shaft 40 passes.

A separation rib 52*b* is formed on the surface of the body part 51 around the boss part 52 of the bracket to separate the clutch spring 60 from the surface of the body part 51 by a predetermined distance. A size of the separation rib 52*b* can be appropriately determined in consideration of that of the clutch spring 60. Due to the fact that the separation rib 52*b* cooperates with a first circular rib 81*a* of a support part 81 of the gear member 80 for the rotation shaft 40, the clutch spring 60 is prevented from being moved in an axial direction of the boss part 52.

The clutch spring 60 has a middle portion 60*a* which is coiled by several turns and a pair of projecting ends 60*b* and 60*c* which are bent to define a predetermined angle between them. The middle portion 60*a* of the clutch spring 60 is placed around the boss part 52 of the bracket 50 and seated on the separation rib 52*b*.

The rotation gear 70 has a tubular gear body 71 which possesses an annular configuration, a ball chain-winding part 72 which is coupled to a surface of the gear body 71 to project in the axial direction and on which the driving ball chain 25 is wound, and a pair of spring operating parts 73 which are formed on an inner surface of the gear body 71 to be spaced apart from each other to thereby operate the clutch spring 60.

The ball chain-winding part 72 is formed in a manner such that balls of the driving ball chain 25 can be sequentially engaged into receiving grooves defined on the ball chain-winding part 72.

Also, the spring operating parts 73 function to allow the clutch spring 60 to be rotated around the boss part 52 of the bracket when the rotation gear 70 is rotated in clockwise and counterclockwise directions by pulling down one and the other portions of the driving ball chain 25. To this end, the spring operating parts 73 are formed on the inner surface of the gear body 71 to be positioned in a large circumference region L of the clutch spring 60, which will be described later in detail. Thus, if the driving ball chain 25 is pulled down, the spring operating parts 73 rotate either one of the projecting ends 60*b* and 60*c* of the clutch spring 60 from the large circumference region L toward a small circumference region S as will be described later in detail, whereby the clutch spring 60 can be freely rotated around the boss part 52 of the bracket. A groove 73*a* is defined on an exposed surface of each spring operating part 73 of the rotation gear 70, which faces the cover 90, and a second circular rib 81*b* of the support part 81 of the gear member 80 is rotatably engaged into the groove 73*a*.

The gear member 80 for the rotation shaft 40 has the support part 81 which possesses an annular configuration, a coupling part 82 which projects from a surface of the support part 81 and is coupled with the rotation shaft 40, and a pair of rotation preventing parts 83 which project from the surface of the support part 81 around and in parallel with the coupling part 82 and are positioned in the large and small circumference regions L and S of the clutch spring 60.

The support part 81 cooperates with the separation rib 52*b* of the bracket to prevent the clutch spring 60 from being moved in the axial direction of the rotation shaft 40. The first circular rib 81*a* is projectedly formed on the surface of the support part 81 of the gear member 80 for the rotation shaft 40.

The first circular rib 81*a* projects from the surface of the support part 81 around the coupling part 82 to have a predetermined thickness. Hence, in fact, the clutch spring 60 is rotatably held between the separation rib 52*b* and the first circular rib 81*a*.

The second circular rib 81*b* having a larger diameter than the first circular rib 81*a* is projectedly formed radially outward of the first circular rib 81*a*. The second circular rib 81*b* is rotatably fitted into the grooves 73*a* defined on the exposed surfaces of the spring operating parts 73 of the rotation gear 70. Due to this rotatable fitting engagement of the second circular rib 81*b* into the grooves 73*a*, even when the rotation gear 70 is rotated, the gear member 80 for the rotation shaft 40 is not rotated.

Of the pair of rotation preventing parts 83 for preventing rotation of the clutch spring 60, one is positioned in the small circumference region S of the clutch spring 60 and the other is positioned in the large circumference region L of the clutch spring 60.

The cover 90 is placed on an outer surface of the gear member 80 for the rotation shaft 40. The cover 90 is detachably fastened to the bracket in a state where the clutch spring 60, the rotation gear 70, and the gear member 80 for the rotation shaft 40 are accommodated in the bracket.

A plurality of coupling bosses 90*a* and 90*b* for coupling the bracket and the cover 90 with each other are formed on opposing surfaces of the bracket and the cover 90. In a state wherein the coupling bosses 90*a* and 90*b* are aligned with each other, by threading screws through the coupling bosses 90*a* and 90*b*, the cover 90 is detachably coupled to the bracket.

Referring to FIGS. 4*a* and 4*b*, the clutch spring 60 has the large and small circumference regions L and S which are bordered from each other by the pair of projecting ends 60*b* and 60*c*. When either one of the projecting ends 60*b* and 60*c* is biased from the small circumference region S toward the large circumference region L, the clutch spring 60 is twisted to be prevented from being rotated around the boss part 52. On the contrary, when either one of the projecting ends 60*b* and 60*c* is biased from the large circumference region L toward the small circumference region S, the clutch spring 60 is untwisted to be freely rotated around the boss part 52.

Referring to FIGS. 2 through 4*b*, as the cloth 20 is willing to sag from its own weight, the cloth 20 forces the rotation shaft 40 to rotate. If the rotation shaft 40 is rotated by the weight of the cloth 20, the gear member 80 for the rotation shaft 40 starts to rotate by the medium of the coupling part 82 which is coupled with the rotation shaft 40. In this case, the rotation preventing part 83 which is positioned in the small circumference region S of the clutch spring 60 biases either one of the projecting ends 60*b* and 60*c* of the clutch spring 60 from the small circumference region S toward the large circumference region L. However, if either one of the projecting ends 60*b* and 60*c* is biased from the small circumference region S toward the large circumference region L, a twisting phenomenon occurs in the middle portion 60*a* of the clutch spring 60, and due to this fact, the clutch spring 60 cannot be rotated around the boss part 52. As a result, since the clutch spring 60 cannot be rotated, it is possible to prevent the cloth 20 from sagging from its own weight.

Referring to FIG. 5, the ball chain box 110 is composed of a front case 112 and a rear case 114 which are closely fitted with each other. The guide groove 116 is vertically defined on the front surface of the ball chain box 110. The driven ball chain 22 is inserted in the guide groove 116 to downwardly extend from the inside of the ball chain box 110.

In each ball chain box 110, an inside gear 120 is fitted around the rotation shaft 40 which is positioned in the frame 10.

Referring to FIG. 6, in the ball chain box 110, the inside gear 120 is meshed with the driven ball chain 22 as shown in FIGS. 2 and 7. That is to say, due to the fact that a plurality of receiving grooves each capable of receiving the ball of the driven ball chain 22 are defined on the inside gear 120, as the rotation shaft 40 and the inside gear 120 are rotated, the driven ball chain 22 is rotated in the clockwise or counterclockwise direction.

Meanwhile, a fastening piece 130 is secured to a bottom surface of the ball chain box 110 and is defined with a ball chain insertion hole 132. An end of the driven ball chain 22 which is positioned in the ball chain box 110 is inserted into the ball chain insertion hole 132. The end of the driven ball chain 22 can be inserted into and removed out of the ball chain insertion hole 132. By this fact, the end of the driven ball chain 22 can be easily secured with respect to the ball chain box 110.

A first release prevention protrusion 140 and a second release prevention protrusion 142 are formed on an inner surface of the ball chain box 110 adjoining an entrance 150 for the driven ball chain 22, so that the driven ball chain 22 can be compiled in the ball chain box 110 without being entangled. Consequently, due to the presence of the guide groove 116 formed on the outer surface of the ball chain box 110, and the first and second release prevention protrusions 140 and 142 formed on the inner surface of the ball chain box 110, it is possible to hold the cloth 20 parallel while preventing the driven ball chain 22 from being entangled.

In Korean Utility Model Registration No. 267467 disclosed by the present applicant, a part which corresponds to the ball chain-winding part 72 of the rotation gear 70 is positioned to face the surface of the body part 51 of the bracket. By this fact, since the driving ball chain 25 is operated while being brought into contact with the surface of the body part 51, when the driving ball chain 25 is pulled down, noise is generated due to friction between the driving ball chain 25 and the surface of the body part 51.

In this consideration, in the present invention, the rotation gear 70 is formed in a manner such that the ball chain-winding part 72 faces the cover 90.

Hereafter, operations of the roman shade according to the present invention, constructed as mentioned above, will be described in detail.

Referring now to FIGS. 2, 6 and 7*a*, if one portion of the driving ball chain 25 is pulled down, the ball chain-winding part 72 which is meshed with the driving ball chain 25 is rotated to rotate the rotation gear 70 in the clockwise direction in FIG. 7*a*.

As the rotation gear 70 is rotated in the clockwise direction, the left spring operating part 73 which is formed on the rotation gear 70 biases the projecting end 60*b* of the clutch spring 60 in the clockwise direction. At this time, since the spring operating part 73 is positioned in the large circumference region L of the clutch spring 60, the projecting end 60*b* of the clutch spring 60 is rotated by the spring operating part 73 from the large circumference region L toward the small circumference region S.

Thereupon, because an untwisting phenomenon occurs in the middle portion 60*a* of the clutch spring 60, as the clutch spring 60 starts to rotate around the boss part 52 in the clockwise direction, the clutch spring 60 pushes the rotation preventing part 83 of the gear member 80 for the rotation shaft 40, whereby the gear member 80 for the rotation shaft 40 is rotated.

As the gear member 80 for the rotation shaft 40 is rotated, the rotation shaft 40 fitted into the gear member 80 is also rotated. By the rotation of the rotation shaft 40, the inside gear 120 which is positioned in each of the ball chain boxes 110 provided on the rotation shaft 40 at the regular interval, is rotated integrally with the rotation shaft 40. Thereafter, as the driven ball chain 22 which is meshed with the inside gear 120 is rotated in the clockwise direction, the cloth 20 which is connected to the driven ball chain 22 by way of the ring 24 is gradually raised. The driven ball chain 22 rotated in the clockwise direction can be compiled in the ball chain box 110 while being prevented from being entangled with the aid of the first and second release prevention protrusions 140 and 142.

On the contrary, as shown in FIG. 7*b*, if the other portion of the driving ball chain 25 is pulled down, the right spring operating part 73 which is formed on the rotation gear 70 biases the projecting end 60*c* of the clutch spring 60 in the counterclockwise direction. At this time, of course, since the force is applied to the projecting end 60*c* from the large circumference region L toward the small circumference region S of the clutch spring 60, the untwisting phenomenon occurs in the middle portion 60*a* of the clutch spring 60.

By this fact, as the clutch spring 60 rotates around the boss part 52 in the counterclockwise direction, the clutch spring 60 rotates the gear member 80 for the rotation shaft 40. Then, the gear member 80 for the rotation shaft 40 rotates the rotation shaft 40 in the counterclockwise direction. By the rotation of the rotation shaft 40, the inside gear 120 which is positioned in each of the ball chain boxes 110 provided on the rotation shaft 40 at the regular interval, is rotated integrally with the rotation shaft 40 in the counterclockwise direction. Thereafter, as the driven ball chain 22 which is meshed with the inside gear 120 is rotated in the counterclockwise direction, the cloth 20 which is connected to the driven ball chain 22 by way of the ring 24 is gradually lowered.

Here, since the driven ball chain 22 moved downward is prevented from being released by the guide groove 116, the cloth 20 can be stably maintained in a balanced state. When the driven ball chain 22 is rotated in the counterclockwise direction, since the end of the driven ball chain 22 is inserted into the ball chain insertion groove 132 of the fastening piece 130, the driven ball chain 22 is prevented from being further rotated. Therefore, the fastening piece 130 serves as a stopper for interrupting the movement of the driven ball chain 22.

In the meanwhile, when raising and lowering the cloth 20, if the force applied to the driving ball chain 25 is removed, the cloth 20 should to reliably held in that position. Namely, the cloth 20 must be prevented from sagging from its own weight. In this regard, reference will be made to FIGS. 8*a* and 8*b*.

With the cloth 20 raised by the above-described operation, if the force applied to the driving ball chain 25 is removed, the rotation shaft 40 starts to rotate by the weight of the cloth 20 in a direction where the cloth 20 is lowered.

In this connection, if the rotation shaft 40 is rotated, the gear member 80 coupled to the rotation shaft 40 starts to rotate in one direction, and then, the rotation preventing parts 83 which are formed on the gear member 80 for the rotation shaft 40 also start to rotate as shown in FIG. 8*a*. Thereafter, the rotation preventing parts 83 start to bias the right projecting end 60*c* which is formed on the clutch spring 60.

However, if the rotation preventing parts 83 bias the projecting end 60*c* from the small circumference region S toward the large circumference region L, the twisting phenomenon occurs in the middle portion 60*a* of the clutch spring 60 to fasten the clutch spring 60 to an outer surface of the boss part 52, whereby the clutch spring 60 cannot be rotated around the outer surface of the boss part 52. Accordingly, the cloth 20 is prevented from sagging from its own weight. This applies in the same manner to the case of FIG. 8*b* irrespective of the force application direction, and therefore, detailed description with regard to FIG. 8*b* will be omitted herein.

As described above, according to the present invention, when the cloth 20 is raised and lowered by pulling down the driving ball chain 25, it is possible to prevent the cloth 20 from sagging from its own weight.

While it was described in the above embodiment that the operation box is provided to a right end of the frame, it is to be readily understood that the operation box can be provided to a left end of the frame, or a pair of operation boxes can be respectively provided to left and right ends of the frame in consideration of convenience upon use.

Although the rotation shaft may be formed to have a sectional shape of a rectangular bar, it is preferred that the rotation shaft has a sectional shape of a cross in consideration of rigidity. Otherwise, the rotation shaft may have a non-circular (such as a star-like) or other polygonal sectional shapes.

While it was described in the above embodiment that the pair of rotation preventing pieces are formed on the gear member for the rotation shaft, it is to be readily understood that one or more rotation preventing pieces may be formed on the gear member for the rotation shaft.

In the above embodiment, one or more ball chain boxes may be provided to the rotation shaft.

While the balls constituting the ball chain may be formed of plastic, it is to be readily understood that the balls may also be made of metallic or non-metallic material suitable for threading on a cord.

While it was described in the above embodiment that the fastening piece is secured to the bottom surface of the ball chain box, it is to be readily understood that the fastening piece may be secured anywhere inside the ball chain box.

INDUSTRIAL APPLICABILITY

As apparent from the above description, the roman shade according to the present invention provides advantages in that a cloth can be maintained in a balanced state and a cord is prevented from being entangled.

Also, the roman shade according to the present invention provides advantages in that gears and ball chains are reliably operated.

Further, the roman shade according to the present invention provides advantages in that noise generation is avoided.

Moreover, the roman shade according to the present invention provides advantages in that the cloth is prevented from sagging to be reliably maintained at a desired height.

Furthermore, the roman shade according to the present invention provides advantages in that the cloth is allowed to be easily replaced or cleaned.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A roman shade comprising:

an operation box section which supports a rotation gear for rotating as a driving ball chain is pulled down;

a rotation shaft fitted into the rotation gear so as to be driven thereby;

a frame surrounding the operation box and the rotation shaft and secured to a wall or ceiling; and a ball chain box section including an inside gear which is fitted around the rotation shaft, a driven ball chain which has balls engaged into grooves defined on the inside gear so that the driven ball chain is moved in upward and downward directions as the inside gear is rotated, a receptacle in which the driven ball chain is collected and stored without being entangled: and an external front surface of the ball chain box section having a lengthwise open groove therein for guiding the ball chain.

2. The roman shade as set forth in claim 1, wherein the inside gear is located above the groove and the receptacle.

3. The roman shade as set forth in claim 2, wherein the ball chain box is composed of front and rear cases, and a fastening piece which is defined with a ball chain insertion hole is secured to one or both of the front and rear cases.

4. The roman shade as set forth in any one of the claims 1 to 3, wherein one or more ball chain release-preventing protrusions are formed at predetermined locations inside the receptacle.

5. The roman shade as set forth in any one of the claims 1 to 3, wherein hook and loop fastener strips are attached to a front surface of the frame and an upper portion of a cloth, which is to be brought into contact with the front surface of the frame.

6. The roman shade as set forth in claim 1, wherein the operation box section comprises:

a bracket having a body part and a tubular boss part which projects from a surface of the body part and through which the rotation shaft passes;

a clutch spring placed around the boss part and having large and small circumference regions which are bordered from each other by a pair of projecting ends constituting both ends of the clutch spring, so that the clutch spring is twisted to be prevented from being rotated when either one of the projecting ends is biased from the small circumference region toward the large circumference region and the clutch spring is untwisted to be freely rotated when either one of the projecting ends is biased from the large circumference region toward the small circumference region;

a second rotation gear having a gear body which is fitted around the boss part of the bracket by way of the clutch spring and possesses an annular configuration, a ball chain-winding part which is coupled to a surface of the gear body to project in an axial direction and on which the ball chain is wound, and a pair of spring operating parts which are formed on an inner surface of the gear body and positioned in the large circumference region of the clutch spring;

a gear member for the rotation shaft, having a support part, a coupling part which projects from a surface of the support part and is coupled with the rotation shaft, and a pair of rotation preventing parts which project from the surface of the support part around and in parallel with the coupling part and are positioned in the large and small circumference regions of the clutch spring; and a cover detachably fastened to the bracket in a state where the clutch spring, the rotation gear, and the gear member for the rotation shaft are accommodated in the bracket.

7. The roman shade as set forth in claim 6, wherein a separation rib is formed on the body part around the boss part of the bracket to separate the clutch spring from the surface of the body party by a predetermined distance.

8. The roman shade as set forth in claim 6, wherein a first circular rib is formed on the surface of the support part of the gear member to be positioned around the boss part of the bracket and thereby prevent the clutch spring from being moved in an axial direction of the rotation shaft.

9. The roman shade as set forth in claims 6 or 8, wherein a groove is formed on an exposed surface of each spring operating part of the rotation gear, which faces the cover, and a second circular rib is formed on the surface of the support part of the gear member to be rotatably engaged into the groove.

10. The roman shade as set forth in claim 9, wherein the second circular rib is placed radially outward of the first circular rib.

11. A roman shade comprising:

an operation box section for rotating a rotation gear as a driving ball chain is pulled down;

a rotation shaft fitted into the rotation gear;

a frame surrounding the operation box and the rotation shaft and secured to a wall or ceiling; and a ball chain box section including an inside gear which is fitted around the rotation shaft, a driven ball chain which has balls engaged into grooves defined on the inside gear so that the driven ball chain is moved in upward and downward directions as the inside gear is rotated, and a receptacle in which the driven ball chain is compiled without being entangled;

wherein the operation box section includes:

a bracket having a body part and a tubular boss part which projects from a surface of the body part and through which the rotation shaft passes;

a clutch spring placed around the boss part and having large and small circumference regions which are bordered from each other by a pair of projecting ends constituting both ends of the clutch spring, so that the clutch spring is twisted to be prevented from being rotated when either one of the projecting ends is biased from the small circumference region toward the large circumference region and the clutch spring is untwisted to be freely rotated when either one of the projecting ends is biased from the large circumference region toward the small circumference region;

a second rotation gear having a gear body which is fitted around the boss part of the bracket by way of the clutch spring and possesses an annular configuration, a ball chain-winding part which is coupled to a surface of the gear body to project in an axial direction and on which the ball chain is wound, and a pair of spring operating parts which are formed on an inner surface of the gear body and positioned in the large circumference region of the clutch spring;

a gear member for the rotation shaft, having a support part, a coupling part which projects from a surface of the support part and is coupled with the rotation shaft, and a pair of rotation preventing parts which project from the surface of the support part around and in parallel with the coupling part and are positioned in the large and small circumference regions of the clutch spring;

a cover detachably fastened to the bracket in a state where the clutch spring, the rotation gear, and the gear member for the rotation shaft are accommodated in the bracket; and wherein a groove is formed on an exposed surface of each spring operating part of the rotation gear, which faces the cover, and a second circular rib is formed on the surface of the support part of the gear member to be rotatably engaged into the groove.

12. The roman shade as set forth in claim 11, wherein a first circular rib is formed on the surface of the support part of the gear member to be positioned around the boss part of the bracket and thereby prevent the clutch spring from being moved in an axial direction of the rotation shaft.

13. The roman shade as set forth in claim 11 or 12, wherein the second circular rib is placed radially outward of the first circular rib.

* * * * *